US005427130A

United States Patent [19]

Yang

[11] Patent Number: 5,427,130

[45] Date of Patent: Jun. 27, 1995

[54] PARASOL STRUCTURE

[76] Inventor: Teng-Yen Yang, No. 4, Tou Chien Tsuo, Tzu Yun Tsun, Chu Chi Hsiang, Chiai Hsien, Taiwan

[21] Appl. No.: 320,934

[22] Filed: Oct. 11, 1994

[51] Int. Cl.[6] ..... A45B 25/06

[52] U.S. Cl. ..... 135/28; 135/40

[58] Field of Search ..... 135/15.1, 25.33, 28, 135/37, 38, 39, 40, 41, 24, 25.4

[56] References Cited

U.S. PATENT DOCUMENTS 5,020,557 6/1991 Apple ..... 135/28 X
5,184,639 2/1993 Lee ..... 135/28
5,357,994 10/1994 Chung ..... 135/40 X

*Primary Examiner*—Lanna Mai

*Attorney, Agent, or Firm*—Browdy and Neimark

[57] ABSTRACT

A parasol structure in which the handle is formed with multiple equally spaced through holes and a locating plate is pivotally disposed inside the handle. The locating plate has multiple equally spaced locking projections corresponding to and extending through the through holes of the handle. A compression spring is disposed behind each locking projection. The lower nest-like body is provided with inner pressing block, whereby the parasol cover can be adjustably stretched and selectively located at one of multiple stages of positions. The pressing block is disposed inside the lower nest-like body to easily retract the locking projection and contract the cover member without the possibility of injury of the user's fingers.

1 Claim, 4 Drawing Sheets

PARASOL STRUCTURE

BACKGROUND OF THE INVENTION

The present invention relates to an improved parasol structure.

A conventional parasol is used to shade the sunlight and the cover of the parasol often has a large area for achieving reliable shading effect.

As shown in FIG. 1, the conventional parasol 1 includes a tip section 11, a cover member 12, multiple cover ribs 13, multiple support ribs 14, an upper and a lower spheric nest-like bodies 15, 16 and a handle 17. The upper end of each cover rib 13 is pivotally connected with the upper nest-like body 15, while one end of each support rib 14 is similarly pivotally connected with the lower nest-like body 16. The other end of the support rib 14 is pivotally connected at a middle section of the cover rib 13. When used, a user holds the lower nest-like body 16 and slides the same along the handle 17. Because the cover ribs are pivotally connected with the lower nest-like body 16 and the support ribs 14 are pivotally connected at the central portions of the cover ribs 13, when the lower nest-like body 16 is slided, the cover ribs 13 are stretched open or contracted inward.

A radial through hole 171 is formed on an upper portion of the handle 17 for receiving a locking plate 18 which has an arch bottom face and a rearward extending post 181, whereby a compression spring 19 is fitted on the post 181. When the lower nest-like body 16 is slided upward along the handle 17 to abut against the arch bottom face of the locking plate 18, the same is retracted into the handle 17 to compress the compression spring 19. After the bottom face of the lower nest-like body 16 passes through the locking plate 18, the locking plate 18 is pushed out of the handle 17 by means of the resilient force of the compression spring 19 to stop the lower nest-like body 16 from sliding downward. When it is desired to contract the parasol, the locking plate 18 is retracted into the handle 17, permitting the lower nest-like body 16 to slide downward in order to contract the parasol.

Several, shortcomings exist in the above arrangements of the conventional parasol as follows:

1. The locking plate is located in the through hole of the handle to stop the lower nest-like body and fix the parasol in a stretched state. Since only one locking plate and one through hole are disposed on the handle, the lower nest-like body can be only located at a single position without the possibility of adjustment.
2. When contracting the parasol, the locking plate is first retracted into the handle to permit the lower nest-like body to slide downward. The lower nest-like body, support ribs, cover ribs and cover all have considerably large weight so that the user must exert great force on the locking plate in order to retract the same into the handle. Therefore, the user often first holds and upward slides the lower nest-like body and then presses the locking plate inward to allow the lower nest-like body to slide downward. Accordingly, the parasol contracting procedure is accomplished by two hands. This is laborious and troublesome. Moreover, the user's fingers may be clamped and injured when pressing the locking plate to slide the lower nest-like body downward.

SUMMARY OF THE INVENTION

It is therefore a primary object of the present invention to provide an improved parasol structure in which the handle is formed with multiple equally spaced through holes and a locating plate is pivotally disposed inside the handle. The locating plate has multiple equally spaced locking projections corresponding to and extending through the through holes of the handle. A compression spring is disposed behind each locking projection. The lower nest-like body is provided with inner pressing block, whereby the parasol cover can be adjustably stretched and selectively located at one of multiple stages of positions.

It is a further object of the present invention to provide the above parasol in which an arch groove is formed on one side of the inner lower edge surrounding the through hole and an opening being formed at the top of the arch groove, whereby a pressing block is received in the opening and the arch groove. The pressing block has a pressing section protruding outside the opening so as to easily retract the locking projection and contract the cover member without the possibility of injury of the user's fingers.

The present invention can be best understood through the following description and accompanying drawings, wherein:

DETAILED DESCRIPTION OF THE PREFERRED EMBODIMENT

Figure 1:
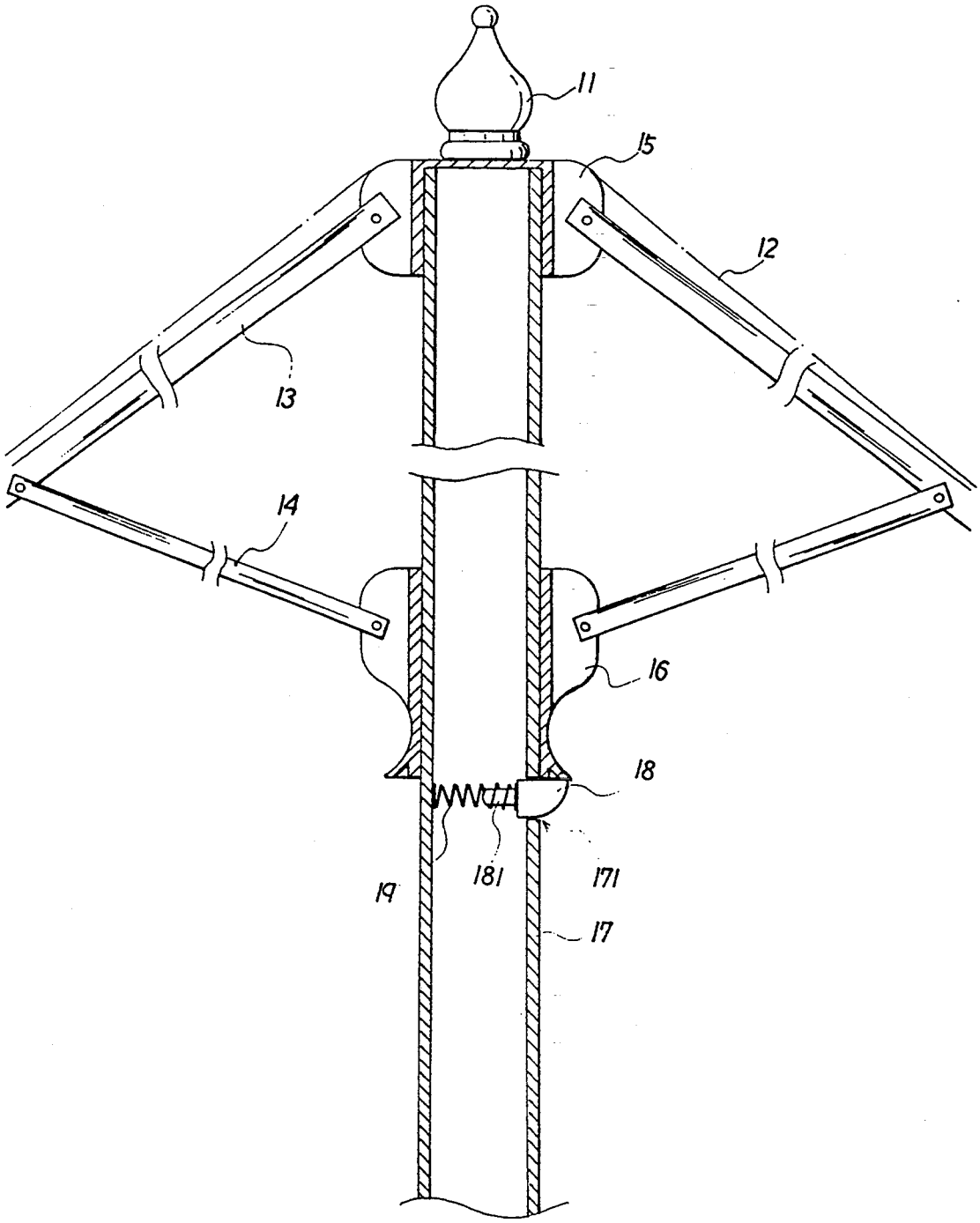
Prior Art FIG. 1
FIG. 1 is a longitudinal sectional view of the conventional parasol.
Figure 2:
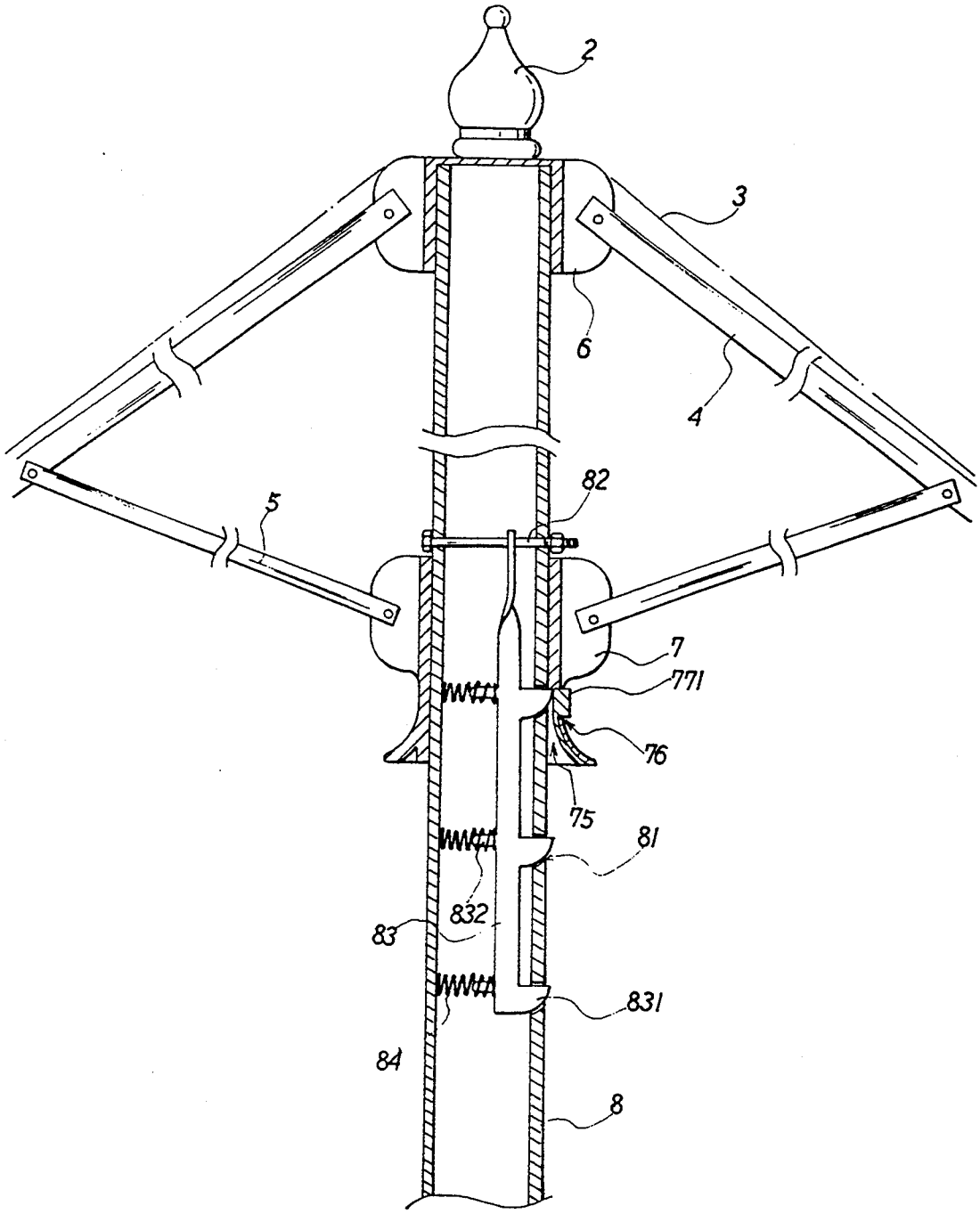
FIG. 2 is a longitudinal sectional view of the present invention.

Please refer to FIG. 2. The parasol of the present invention includes a tip member 2, a cover member 3, multiple cover ribs 4, multiple support ribs 5, an upper spheric nest-like body 6, a lower spheric nest-like body 7 and a handle 8, wherein the tip member 2, cover member 3, cover ribs 4, support ribs 5 and upper nest-like body 6 pertain to prior art.

Figure 3:
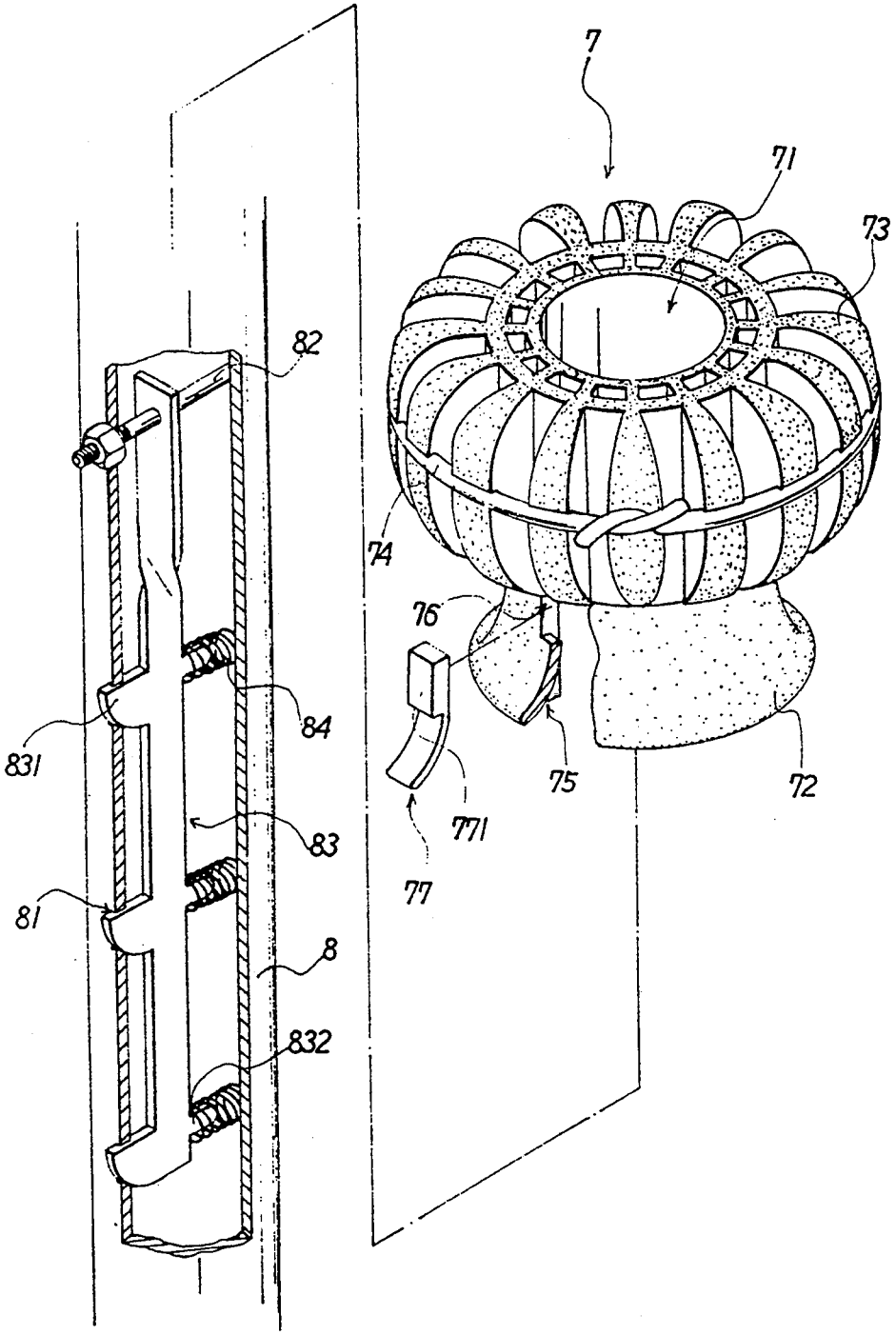
FIG. 3 is a partially sectional and partially perspective view of the present invention.
Figure 4:
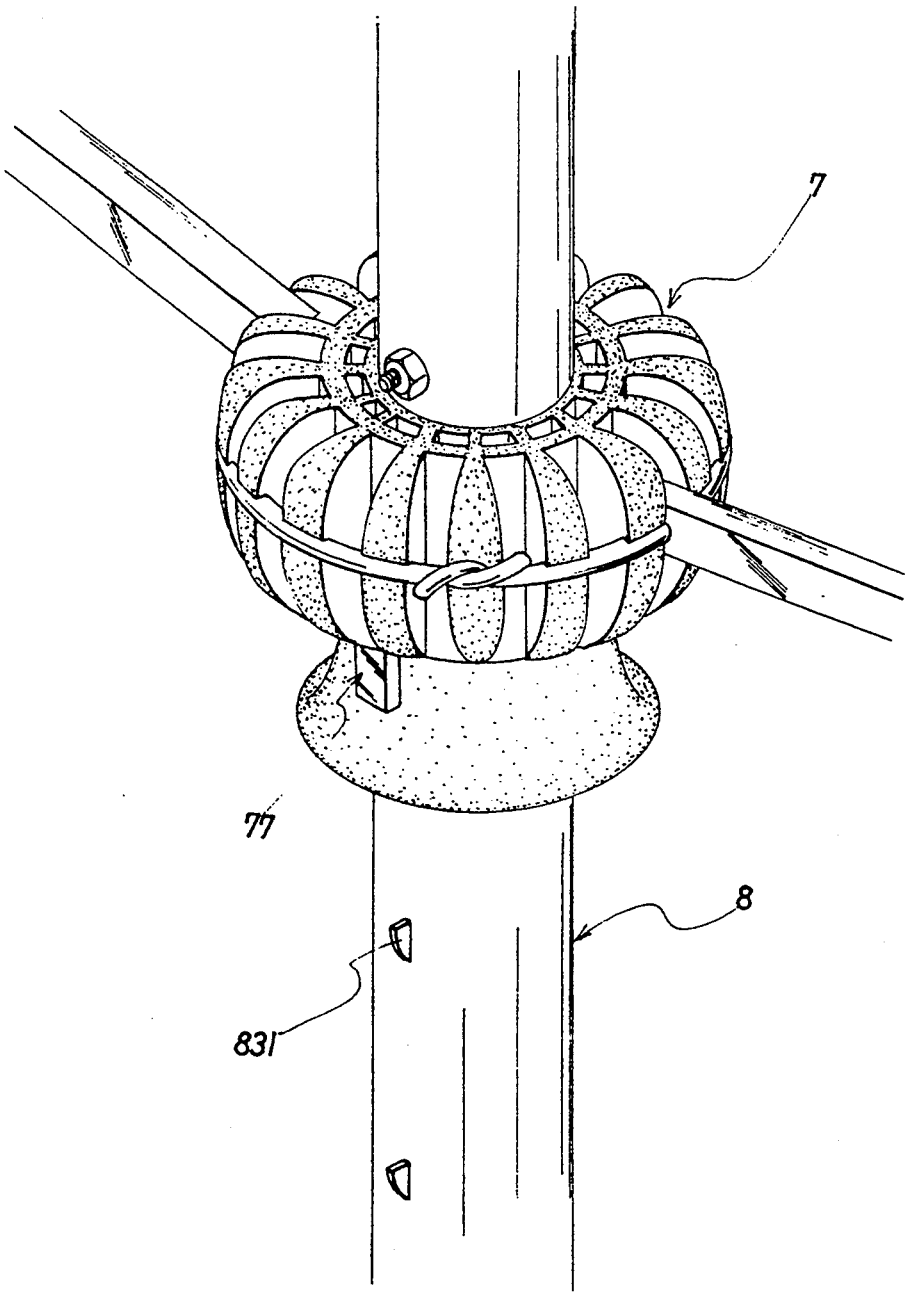
FIG. 4 is a perspective view of the lower nest-like body and the locking projections of the locating plate of the present invention.

Please refer to FIGS. 3 and 4. The lower nest-like body 7 is formed with a central through hole 71 for the handle 8 to pass therethrough and a downward extending grip portion 72. In addition, multiple equally spaced outward projecting plates 73 are disposed around the periphery of the lower nest-like body 7 and an annular groove is formed on a central section of the projecting plates 73 for receiving an iron wire 74. An arch groove 75 is formed on one side of the inner lower edge surrounding the through hole 71 and an opening 76 is formed at the top of the arch groove 75, whereby a pressing block 77 is received in the opening 76 and the arch groove 75. The pressing block 77 has a pressing section 771 protruding outside the opening 76.

The handle 8 is formed with multiple equally spaced through holes 81 on an upper portion and a bolt 82 is diametrically passed through the handle 8, whereby a locating plate 83 is pivotally connected with the bolt 82 in the handle 8. The locating plate 83 has multiple equally spaced outward extending locking projections 831 corresponding to and protruding outside the through holes 81 of the handle 8. An inward extending support post 832 is formed behind each locking projection 831 and a compression spring 84 is fitted on the support post 832.

According to the above arrangements, when it is desired to stretch open the cover member 3, the lower nest-like body 7 is slided upward along the handle 8. Because the bottom face of the locking projection 831 is arched, when the lower nest-like body 7 is slided upward, the locking projections 831 are retracted into the handle 8 and the locating plate 83 compresses the compression springs 84 and moves rearward along the bolt 82. At this time, the lower nest-like body 7 can be smoothly slided upward along the handle 8. When reaching a desired position, one of the locking projections 831 is aligned with the opening 76 of the lower nest-like body 7 and the locating plate 83 is pushed forward by means of the resilient force of the compression springs 84, making the locking projection 831 engage with the inner edge of the opening 76 of the lower nest-like body 7 and abut against the pressing block 77. Therefore, the cover member can be adjustably stretched and selectively located at one of multiple stages of positions. When it is desired to contract the parasol, the user only needs to press the pressing block 77 inward to retract the locking projection 831 inside the handle 8 and make the locating plate 83 compress the compression springs 84. At this time, the lower nest-like body 7 is permitted to be slided downward in order to contract the cover member.

It can be known from the above that the present invention has the following advantages when compared with the conventional parasol:

1. The cover member can be selectively located at one of multiple stages of positions and the stretching angle of the cover member can be adjusted.
2. The pressing block is disposed inside the lower nest-like body to easily retract the locking projection and contract the cover member without the possibility of injury of the user's fingers.

The above embodiment is only an example of the present invention and the scope of the present invention should not be limited to the example. Any modification or variation derived from the example should fall within the scope of the present invention.

What is claimed is:

1. A parasol structure comprising a tip member, a cover member, multiple cover ribs, multiple support ribs, an upper spheric nest-like body, a lower spheric nest-like body and a handle, wherein an upper end of each cover rib is pivotally connected with the upper nest-like body, while one end of each support rib is similarly pivotally connected with the lower nest-like body, the other end of the support rib being pivotally connected at a middle section of the cover rib, whereby when used, a user holds the lower nest-like body and slides the same along the handle to stretch open or contract the cover ribs, and wherein:

the lower nest-like body is formed with a central through hole for the handle to pass therethrough and a downward extending grip portion, multiple equally spaced outward projecting plates being disposed around the periphery of the lower nest-like body and an annular groove is formed on a central section of the projecting plates for receiving an iron wire, an arch groove being formed on one side of the inner lower edge surrounding the through hole and an opening being formed at the top of the arch groove, whereby a pressing block is received in the opening and the arch groove, the pressing block having a pressing section protruding outside the opening; and the handle is formed with multiple equally spaced through holes on an upper portion and a bolt is diametrically passed through the handle, whereby a locating plate is pivotally connected with the bolt in the handle, the locating plate having multiple equally spaced outward extending locking projections corresponding to and protruding outside the through holes of the handle, an inward extending support post being formed behind each locking projection and a compression spring being fitted on the support post, whereby the pressing block facilitates the retraction of the locating plate and the multiple equally spaced locking projections of the locating plate and the through holes of the handle permit the user to selectively locate the cover member at one of multiple stages of positions and adjust the stretching angle thereof.

* * * * *